United States Patent [19]

Le Gac et al.

[11] Patent Number: 4,884,633

[45] Date of Patent: Dec. 5, 1989

[54] A HYDRAULIC REMOTELY-CONTROLLED BLEEDER VALVE FOR A WELL HEAD

[75] Inventors: Jean-Yves Le Gac, Beynes; Denis Devilleger, Marcq; Philippe Majewski, Sorel-Moussel, all of France

[73] Assignee: Gaz de France, Paris, France

[21] Appl. No.: 303,208

[22] Filed: Jan. 27, 1989

[30] Foreign Application Priority Data

Jan. 28, 1988 [FR] France ..... 88 00996

[51] Int. Cl.[4] ..... E21B 34/02; F16K 31/163

[52] U.S. Cl. ..... 166/75.1; 166/323; 166/97; 251/63; 251/63.5

[58] Field of Search ..... 166/97, 332, 385, 386, 166/72, 75.1, 84, 319, 323; 251/63, 63.5; 277/27

[56] References Cited

U.S. PATENT DOCUMENTS

| | | | |
|---|---|---|---|
| 3,512,550 | 5/1970 | Ammann | 251/63 X |
| 3,762,725 | 10/1973 | Taylor | 166/84 X |
| 4,040,600 | 8/1977 | Coppola et al. | 251/63 |
| 4,442,859 | 4/1984 | Gentry | 166/84 |
| 4,444,259 | 4/1984 | Schwall | 166/371 X |
| 4,618,000 | 10/1986 | Burris | 166/373 |

*Primary Examiner*—Randolph A. Reese
*Assistant Examiner*—Arlen L. Olsen
*Attorney, Agent, or Firm*—Dykema Gossett

[57] ABSTRACT

The bleeder comprises a hydraulically remotely controlled bleed valve (150) and device for guaranteeing that during bleeding, the gas is exhausted away from the well head zone. The bleed valve (150) is advantageously situated at the top end of the pressure lock and has a valve body (9) defining a main channel (17) of sufficient cross-section to pass to wireline tool. The bleed valve also has a gas exhaust lateral orifice (16) for being put selectively into communication with a first transverse channel (15) which opens out into the main channel (17) by a closure member constituted by a valve seat and a valve member formed at one end of a piston (5). A second transverse channel (14) puts the main channel (17) into communication with a rear face of the piston (5), where the rear face has a greater section than its valve-forming front face. A lateral hydraulic fluid receiving control orifice (13) is connected to a hydraulic remote control flexible hydraulic pipe and opens out into a bore defining an annular space around a portion of the piston (5), the bore being of smaller section than the rear face of the piston in contact with the gas present in the second transverse channel (14).

7 Claims, 3 Drawing Sheets

A HYDRAULIC REMOTELY-CONTROLLED BLEEDER VALVE FOR A WELL HEAD

The present invention relates to a pressure lock bleeder for a well head giving access to a hydrocarbon deposit or to an underground store of gas.

BACKGROUND OF THE INVENTION

Natural gas deposits are exploited by means of a production well. The gas extracted from the ground in production zones is then transported, e.g. by means of pipelines, to utilization zones, or else large quantities of gas may be stored underground again in the form of underground layers of gas.

Access is obtained to layers of gas stored underground likewise by means of a well of conventional configuration. It is often necessary to take action in production wells giving access to deposits of gas or in service wells subjected to the pressure of supply of gas stored underground.

For this purpose, a pressure lock is disposed by lifting tackle on top of the blow-out preventer (BOP) situated on the well head, after a wireline tool has previously been installed in the pressure lock. After the pressure lock has been connected to the BOP, the well head operating valve is opened in order to equalize the pressure in the pressure lock (which was initially at atmospheric pressure) and in the well (which may be subjected to pressure of the order of $10^7$ to $2.10^7$ pascals). The tool is then lowered down the well by means of a winch and the cable which is connected to the tool. After the action has been performed by the tool, it is raised back into the pressure lock and the well head operating valve is closed.

Thereafter, the gas contained in the pressure lock and the wire closure valve of the BOP needs to be bled off before the pressure lock can be disconnected from the BOP.

The operation of bleeding the gas present under pressure in the pressure lock is normally performed by means of a small, manually controlled bleed valve situated at the bottom end of the pressure lock above the BOP. However, this method of proceeding suffers from several drawbacks. In particular, the operator must climb up scaffolding in order to be able to open the bleed valve which is not directly accessible from the ground even though it is situated at the bottom end of the pressure lock. There is thus a risk of the operator falling. In addition, when the valve is opened, the operator is immersed in gas and is directly subjected to the aggression of the considerable noise generated when the valve is opened by virtue of the fact that the gas is throttled. Insofar as the operator opens the valve progressively in order to control the speed of gas escape, he must remain on the scaffolding and be subjected to the noise and the gas aggression throughout the time required for bleeding.

Since the manual bleed valve is situated at a height of about 2 meters above the ground, it may give rise to a very low altitude cloud of gas being formed, thereby running a risk of explosion since the pressure lock is normally hoisted by means of a crane fixed to a truck located in the vicinity of the well head, with the internal combustion engine of the truck running in order to provide the hydraulic power required by the crane.

The present invention seeks to remedy the above-mentioned drawbacks and to enable a well head pressure lock to be bled in a convenient manner while also providing a high degree of safety for the personnel concerned.

SUMMARY OF THE INVENTION

These objects are achieved by means of a bleeder for the pressure lock of a well head giving access to an underground store of gas, the bleeder comprising a hydraulically remotely controlled bleed valve and means for guaranteeing that gas exhaust takes place during bleeding away from the well head zone, the bleed valve comprising a valve body defining a main channel of sufficient cross-section to pass a wireline tool and connected at one of its ends to one of the pressure lock components and at its other end to an assembly fixed to the well head or to an assembly for connection to a control system for a wireline tool, a lateral gas exhaust orifice for being put selectively into communication with a first transverse channel opening out into the main channel by means of a closure member constituted by a valve seat and a valve member formed at one end of a piston, a second transverse channel putting the main channel into communication with a rear face of the piston, said rear face having a greater section than its valve-forming front face, and a lateral hydraulic fluid receiving control orifice connected to a hydraulic remote control flexible pipe and opening out into a bore defining an annular space around a portion of the piston, said bore being of smaller section than the rear face of the piston in contact with the gas present in said second transverse channel.

In a first embodiment, the hydraulically remote controlled bleed valve is situated at the bottom end of the pressure lock, and the gas exhaust orifice of the valve is connected to a pipe whose free end through which the gas exhausts is situated at several meters from the well head.

In another embodiment, the hydraulically remote controlled bleed valve is situated at the top end of the pressure lock and the gas is exhausted to the atmosphere directly through the gas exhaust orifice of the valve.

Preferably, the bleed valve also includes a spring exertin a force on the rear face of the piston tending to close the closure member when hydraulic pressure is not applied via the remote control flexible pipe and the lateral control orifice.

The pressure applied via the hydraulic remote control pipe is not less than the pressure existing in the well plus about $15.10^5$ pascals.

BRIEF DESCRIPTION OF THE DRAWINGS

An embodiment of the invention is described by way of example with reference to the accompanying drawings, in which:

FIG. 3 shows the FIG. 2 valve in its open position for bleeding the gas contained in the pressure lock on which the bleed valve is mounted.

MORE DETAILED DESCRIPTION

Figure 1:
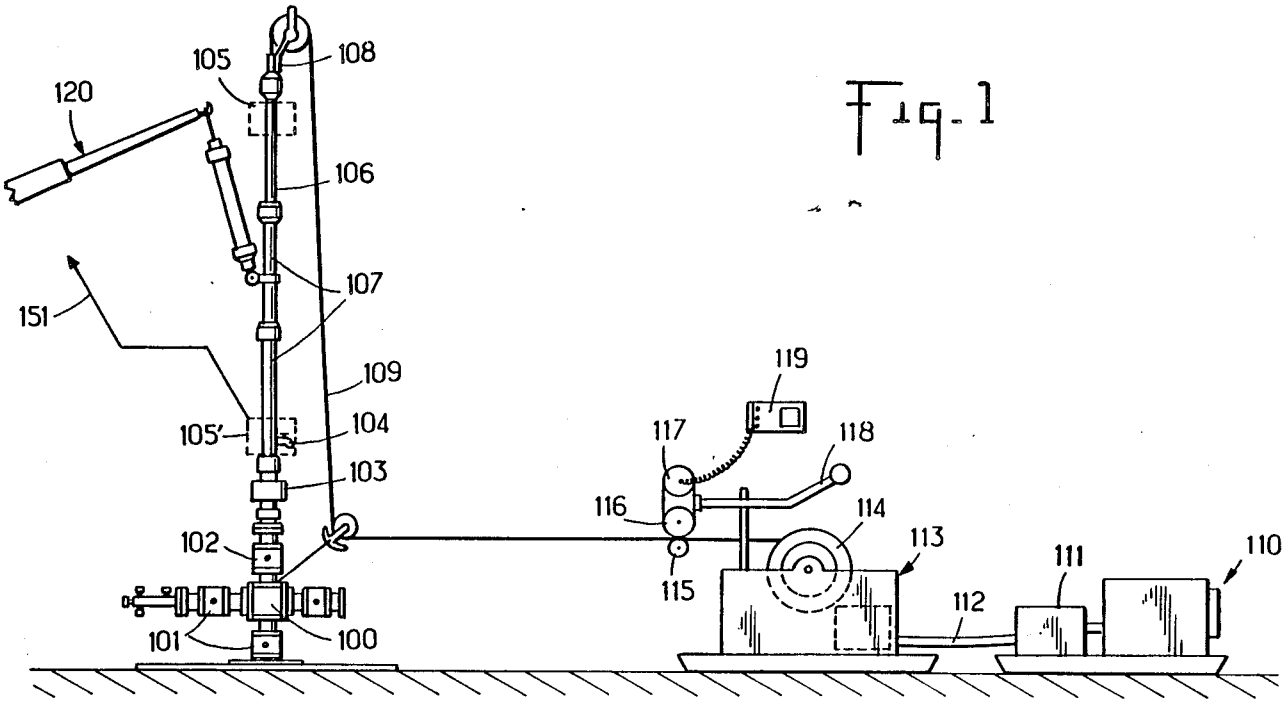
FIG. 1 is a diagrammatic elevation of a well head fitted with a pressure lock and a tool-controlling cable system, to which the bleeder of the invention is applicable.

FIG. 1 shows a well head 100 equipped with a pressure lock 106, 107 and a tool-controlling cable system 108 to 119, to which the bleeder of the invention is applicable, as designated in FIG. 1 by references 105 and 105=.

When action is performed via a well head 100 fitted with valves 101, with an operating valve disposed between the well head per se, and a wire closure valve 103 forming part of a blow-out preventer (BOP), a wireline working tool is initially inserted into the pressure lock 106, 107 via its bottom end. The pressure lock is supported by a crane 120 and the tool is connected to a cable 109. The cable 109 leaves from the top end of the pressure lock 106 via an assembly 108 including a sheave and a stuffing box. Once the tool is properly installed in the pressure lock 106, 107, the pressure lock 106, 107 is connected to the BOP 103. The operating valve 102 of the well head 100 is then opened in order to put the pressure lock 106, 107 to the same pressure as the well. An assembly 113 for driving the cable 109 and including a winch 114 serves to lower the tool down the well. The cable-driving assembly 113 is connected by a flexible link 112 to a power unit 110 including a hydraulic pump 111. A lever 118 is used to control cable winding. The position of the cable is permanently monitored by means of a measuring device including a measuring sheave 116 co-operating with a presser wheel 115, a sensor-containing sheave 117, and a read-out box 119 for permanently monitoring the position of the tool.

When the work to be performed by means of the tool lowered down the well has been completed, the tool is raised back into the pressure lock 106, 107 by means of the same winch 114. The well head operating valve 102 is then closed and the gas contained in the pressure lock and in the BOP 103 then needs to be bled off. In conventional installations, such bleeding is performed by means of a manually-controlled valve such as a faucet or tap 104 situated at the bottom of the pressure lock 106, 107. As mentioned in the introduction of this description, this method of bleeding suffers from numerous drawbacks and does not provide sufficient safety.

The bleeder of the invention which may be disposed level either with the block 105 or with the block 105' in FIG. 1 allows the gas contained in the pressure lock and in the BOP to be bled off in complete safety prior to the pressure lock being disconnected from the BOP 103.

The bleeder 150 of the invention for bleeding off the gas contained in the wireline pressure lock 106, 107 prior to its disconnection from the wire closure 103 is described with reference to FIGS. 2 and 3.

The pressure lock bleeder 150 may be incorporated between the top pressure lock component 106 and the sheave and stuffing box assembly 108 (block 105 in FIG. 1).

In another embodiment, the bleeder 150 may be disposed at the bottom end of the pressure lock between the bottom pressure lock component 107 and the wire closure valve or the BOP 103 (block 105' in FIG. 1). In this case, a pipe 151 is connected to the bleeder in order to exhaust the gas at a location which is distant from the zone in which the operator works and containing the internal combustion engines driving the hoisting gear 120. The gas may be exhausted via the pipe 151 at a height of about 10 meters rather than directly at the level of the block 105' which is normally at a height of about 2 meters. When the bleeder is situated at the level of the block 105, i.e. at the top end of the pressure lock, the gas may be exhausted directly into the atmosphere without using an additional pipe insofar as this top end of the pressure lock is already generally situated at a height of about 10 meters above the ground.

In any event, the bleeder is opened or closed remotely under hydraulic control by means of a flexible pipe which may be about thirty meters long.

Figure 2:
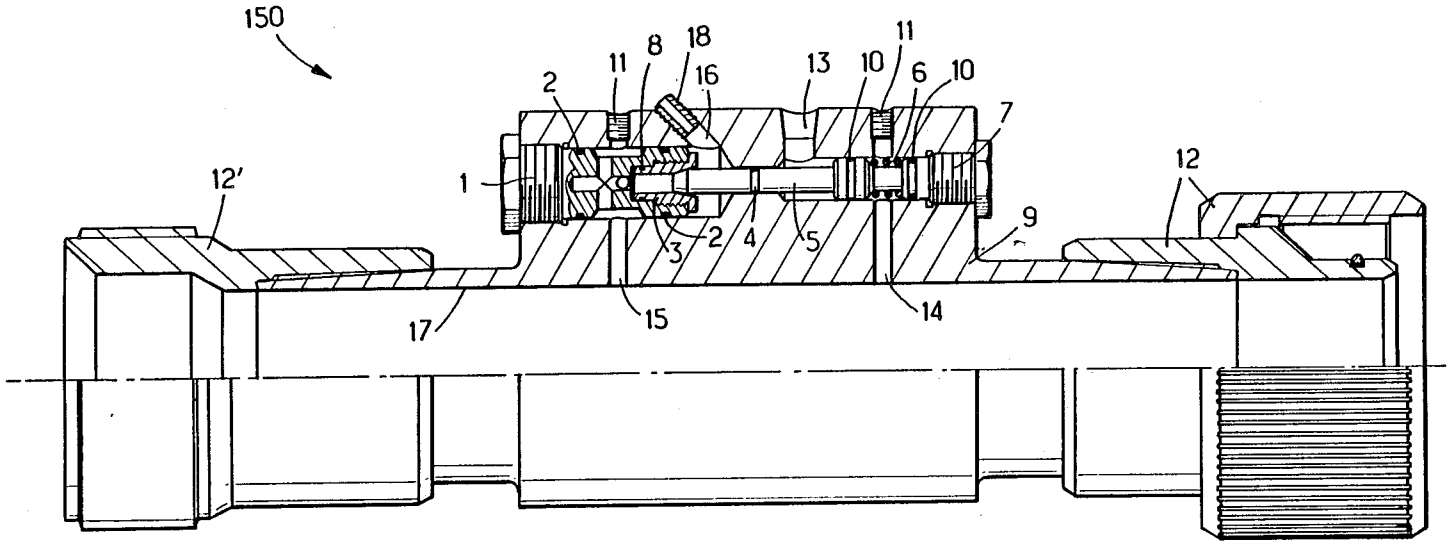
FIG. 2 is an elevation and axial half section view of a bleed valve in accordance with an embodiment of the invention, shown in the closed position, and suitable for mounting on a pressure lock such as that shown in FIG. 1.
Figure 1:
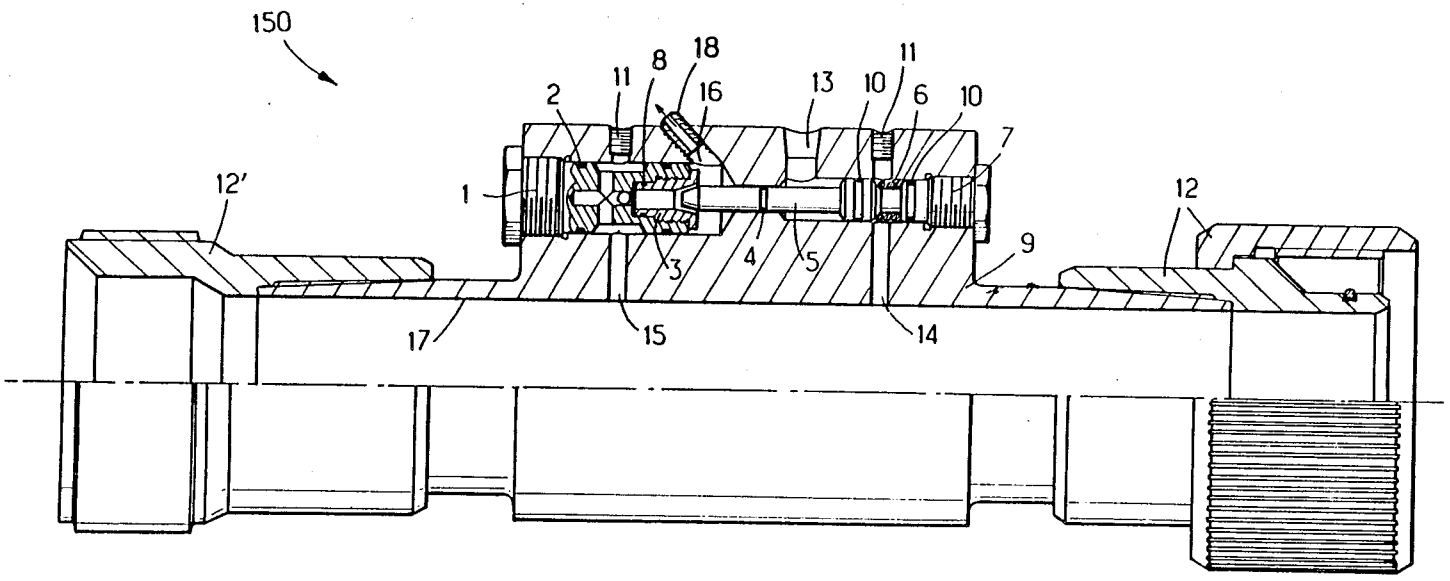

An example of the bleed valve 150 of the invention suitable for mounting in the position 105 of FIG. 1 (for example) is shown in its closed position in FIG. 2 and in its open position for bleeding off the gas contained in the pressure lock in FIG. 3.

The bleed valve 150 comprises a valve body 9 defining a main channel 17 of sufficient section to pass a wireline tool. The valve 150 is connected at one of its ends 12 via a union coupling to one of the pressure lock components, e.g. to the top pressure lock component 106. The other end 12' of the valve 150 is connected, likewise by means of a union coupling, to the assembly 108 (including a stuffing box) for connection to the system for controlling the wireline tool if the valve 150 is located in the position 105 of FIG. 1.

When the valve 150 is disposed in position 105' of FIG. 1, the union coupling 12 may be connected to the bottom component 107 of the pressure lock while the union coupling 12' serves to connect the valve 150 to the BOP 103.

The hydraulic pipe for remote control of the valve 150 is connected thereto via a lateral control orifice 13.

A lateral gas exhausting orifice 16 is put selectively into communication with a first transverse channel 15 opening out into the main channel 17, under the control of a closure member constituted by a valve seat 3 and a valve member forming the end of a piston 5.

A second transverse channel 14 puts the main channel 17 into communication with a rear face of the piston 5 which is of larger section than the section of its valve-forming front face, thereby holding the valve closed when no hydraulic pressure is applied via the lateral orifice 13. The transverse channels 14 and 15 are closed by plugs 11 at their outside ends in order to prevent gas leaks other than through the exhaust orifice 16.

The lateral control orifice 13 connected to a hydraulic remote control flexible pipe opens out into a bore defining an annular space around a portion of the piston 5, with the cross-section of the bore being smaller than the cross-section of the rear face of the piston in contact with the gas present in the transverse channel 14.

Preferably, the bleed valve 150 also includes a spring 6 exerting a force on the rear face of the piston 5 tending to close the closure member 5 when no hydraulic pressure is being delivered by the remote control flexible pipe and the lateral control orifice 13. Sealing rings 2, 4, and 10 are provided to ensure gastight and hydraulic fluid-tight sealing around the piston 5 (sealing rings 4 and 10) and around the insert carrying the valve seat 3 (sealing rings 2).

The operation of the bleed valve shown in FIGS. 2 and 3 is now described. Before the top valve 102 of the well head (FIG. 1) is opened, and with low pressure in the hydraulic pipe, the spring 6 exerts a force on the piston 5 which comes into abutment against its seat 3.

After the well head valve 102 has been opened, and while hydraulic pressure is still not being applied, the gas present in the main channel 17 of the bleed valve 150 passes into both of the channels 14 and 15 and thus reaches not only the orifices in the plug 1 which holds the valve seat 3 in position (via the channel 15), but also the rear face of the piston 5 and the bore containing the spring 6, (via the channel 14). Under the effect of the gas pressure, the piston is pressed against its seat 3 since the area of the piston 5 adjacent its rear sealing ring 10 is greater than its area adjacent its sealing ring 4 situated between the rear face of the piston 5 and its truncated front end which constitutes the valve member of the piston 5.

The pressure lock is decompressed by closing the top valve 102 of the well head, and then increasing the hydraulic pressure in the pipe connected to the control orifice 13 of the valve 150 so as to displace the piston 5 towards the end plug 7 which holds the spring 6 in place, thereby compressing the spring and bringing the piston into abutment against the plug 7. Simultaneously, the top end of the piston 5 disengages the seat 3, thereby allowing the gas to escape towards the exhaust orifice 16 (FIG. 3).

After the gas has been completely exhausted, the hydraulic remote control pipe is depressurized, thereby causing the piston 5 to return to its initial position with the valve member end of the piston coming back into contact with the valve seat 3 under the action of the spring 6.

Given the difference between the sealed cross-sections of the piston 5 together with the force required for compressing the spring 6 and the force required to overcome friction between the piston 5 and the valve body 9 in order to cause the piston 5 to move, the pressure in the hydraulic remote control pipe must be not less than the pressure in the well plus a value of about $15.10^5$ pascals.

It is not absolutely essential to have a spring 6, but its presence is useful for closing the valve in the rest position in the absence of any gas in the pressure lock, in particular at the end of a bleeding operation.

As mentioned above, when the hydraulically remote controlled bleed valve 150 is situated at the top end 105 of the pressure lock 106, 107, the gas is exhausted directly into the atmosphere via the exhaust orifice 16 of the bleed valve 150. In contrast, when the bleed valve 150 is situated at the bottom end 105' of the pressure lock 106, 107, the gas exhaust orifice 16 of the valve 150 is connected to a pipe 151 whose free end through which the gas exhausts is situated at a distance of several meters from the well head 100.

A removable nozzle 18 is advantageously mounted in the gas exhaust orifice 16, said nozzle having a through section which is slightly smaller than the section through which the gas exhausts between the seat 3 and the truncated front end of the piston 5 when the piston is retracted as shown in FIG. 3. This serves to limit wear at the front end of the piston 5, with the gas expanding at the nozzle 18 rather than at the valve-forming front end of the piston 5. The nozzle 18 may be screwed into tapping formed in the orifice 16 and constitutes a part which is cheap and which is easily accessible and which can therefore be replaced without difficulty.

We claim:

1. A bleeder for a pressure lock of a well head giving access to an underground store of gas, the bleeder comprising a hydraulically remotely controlled bleed valve and means for guaranteeing that gas exhaust takes place during bleeding away from the well head zone, and the bleed valve comprising a valve body defining a main channel of sufficient cross-section to pass a wireline tool and connected at one of its ends to one component of the pressure lock and at its other end to an assembly fixed to the well head or to an assembly for connection to a control system for a wireline tool, a gas exhaust lateral orifice for being put selectively into communication with a first transverse channel opening out into the main channel by means of a closure member constituted by a valve seat and a valve member formed at one end of a piston, a second transverse channel putting the main channel into communication with a rear face of the piston, said rear face having a greater cross section that its valve-forming front face, and a lateral hydraulic fluid receiving control orifice connected to a hydraulic remote control flexible hydraulic pipe and opening out into a bore defining an annular space around a portion of the piston, said bore being of smaller cross section than the rear face of the piston in contact with the gas present in said second transverse channel.

2. A bleeder according to claim 1, wherein the hydraulically remote controlled bleed valve is situated at a bottom end of the pressure lock, and wherein the gas exhaust orifice of the valve is connected to a pipe whose free end through which the gas exhausts is situated at several meters from the well head.

3. A bleeder according to claim 1, wherein the hydraulically remote controlled bleed valve is situated at a top end of the pressure lock and wherein the gas is exhausted to the atmosphere directly through the gas exhaust orifice of the valve.

4. A bleeder according to claim 1, wherein the bleed valve also includes a spring exerting a force on the rear face of the piston tending to close the closure member when hydraulic pressure is not applied via the remote control flexible pipe and the lateral control orifice.

5. A bleeder according to claim 1, including a plurality of sealing rings for providing sealing around the piston which is both gastight and hydraulic fluid-tight.

6. A bleeder according to claim 1, wherein the pressure applied via the hydraulic remote control pipe is not less than the pressure existing in the well plus about $15.10^5$ pascals.

7. A bleeder according to claim 1, further including a removeable nozzle which is mounted in the lateral gas exhaust orifice and which has a through passage of section which is slightly smaller than the section of the through passage between said valve member and said valve seat when said closure member is in the open position, thereby limiting wear of said valve.

* * * * *